United States Patent [19]

Ueda et al.

[11] Patent Number: 4,999,614

[45] Date of Patent: Mar. 12, 1991

[54] MONITORING SYSTEM USING INFRARED IMAGE PROCESSING

[75] Inventors: Ryuichi Ueda; Masaaki Nakamura; Toshio Iwasaki; Kanji Hirota, all of Kanagawa; Tetsuya Nakamura, Tokyo, all of Japan

[73] Assignee: Fujitsu Limited, Kawasaki, Japan

[21] Appl. No.: 276,669

[22] Filed: Nov. 28, 1988

[30] Foreign Application Priority Data

Nov. 26, 1987 [JP] Japan ..... 62-299451
May 13, 1988 [JP] Japan ..... 63-117580

[51] Int. Cl.[5] ..... G08B 17/00

[52] U.S. Cl. ..... 340/588; 340/600; 340/567; 358/105; 358/113

[58] Field of Search ..... 340/588, 600, 567; 374/129, 124; 358/113, 105; 250/332, 330

[56] References Cited

U.S. PATENT DOCUMENTS 3,924,130 12/1975 Cohen et al. ..... 358/113
4,408,224 10/1983 Yoshida ..... 358/105
4,608,599 8/1986 Kaneko et al. ..... 358/113
4,779,095 10/1988 Guerreri ..... 358/105
4,807,027 2/1989 Muto ..... 358/105
4,823,290 4/1989 Fasack et al. ..... 340/588

*Primary Examiner*—Joseph A. Orsino
*Assistant Examiner*—Geoff Sutcliffe
*Attorney, Agent, or Firm*—Staas & Halsey

[57] ABSTRACT

Temperature data of each picture element output from a infrared camera looking at a scene to be watched is compared with the same data of a previous frame. Temperature date which has changed from the previous frame is input to a histogram operator having a region defined by the temperature change and quantity of the picture elements. When the quantity of picture elements in the defined region exceeds a threshold level, it is recognized that a certain object having considerable temperature change and size has been detected. Thus, a signal is output to trigger an alarm system, or to sustain circulating frame memories which have recorded the previous scenes so that the scenes of visible light as well as the temperatue patterns for frames before, on, and after the trigger signal can be reproduced as visual images of a display screen.

25 Claims, 6 Drawing Sheets

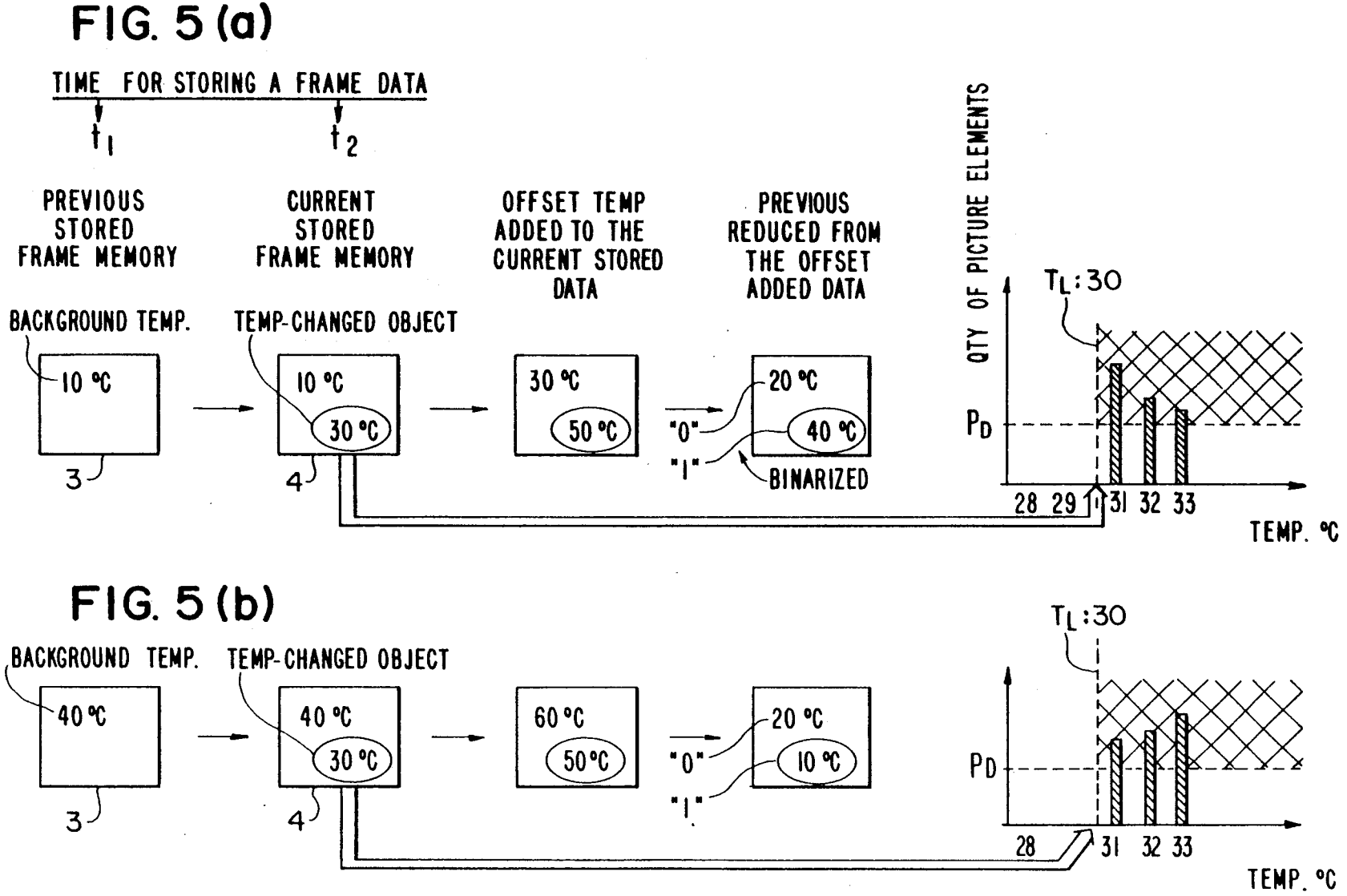
FIG. 5 (a)
TIME FOR STORING A FRAME DATA
$t_1$
$t_2$
PREVIOUS STORED FRAME MEMORY
CURRENT STORED FRAME MEMORY
OFFSET TEMP ADDED TO THE CURRENT STORED DATA
PREVIOUS REDUCED FROM THE OFFSET ADDED DATA
BACKGROUND TEMP.
10 °C
3
TEMP-CHANGED OBJECT
10 °C
30 °C
4
30 °C
50 °C
20 °C
40 °C
"0"
"1"
BINARIZED
QTY OF PICTURE ELEMENTS
$P_D$
$T_L$:30
28 29 31 32 33
TEMP. °C
FIG. 5 (b)
BACKGROUND TEMP.
40 °C
3
TEMP-CHANGED OBJECT
40 °C
30 °C
4
60 °C
50 °C
20 °C
10 °C
"0"
"1"
$P_D$
$T_L$:30
28 31 32 33
TEMP. °C

MONITORING SYSTEM USING INFRARED IMAGE PROCESSING

BACKGROUND OF THE INVENTION

1. Field of the Invention

This invention relates to a monitoring system using an infrared monitoring camera and image processing and, more particularly to detecting either trouble in a facility or the presence of an unexpected person through an unusual temperature rise.

2. Description of the Related Art

Burglar alarm systems have generally employed a video camera system or a light beam sensor system in order to detect an invader. In a video camera system either a watchman has to constantly monitor a display screen or an electronic circuit has to be employed to detect and recognize a change in the video signals. In a light beam sensor system, a beam of invisible light, typically infrared, is projected through the area to be watched. When an invader interrupts the light beam, the presence of the invader is electronically detected. In a facility trouble-finding system, where trouble is typically represented as an abnormal temperature rise of a facility, a contact-type sensor, typically a thermometer, is attached on some part of the facility or a non-contact type infrared detector or camera is employed.

These conventional systems have the following problems. In a system using a video camera, it is impossible for a human to pay constant and perfect attention to the display screen. Therefore, data processing techniques have been employed to electronically detect a change in video information, such as brightness or color. Data processing techniques have also been employed in infrared camera systems to detect a change in temperature of each picture element. Such a system is disclosed in Japanese unexamined patent publication Sho 62-111588.

However, these electronic detection systems detect even a slight change in the object scene, such as a small vibration of a tree, an invasion of a small animal, or a flying leaf. As a result of these undesired detections, the dependability of these conventional systems is low. In order to decrease the excessive sensitivity of systems using a video camera detecting visible light, a system was proposed such that an alarm signal was output only when the quantity of picture elements which have changed more than a predetermined information difference exceeded a predetermined threshold quantity. Such a video camera system is disclosed in the Japanese unexamined patent publication Sho 57-160282.

Moreover, in some temperature measurement systems using a contact-type thermometer, the thermometer needs to be installed on a dangerous part of the facility, such as on a high voltage machine. Accordingly, the installation of the contact-type thermometer is sometimes impossible. An infrared thermometer can be used in place of the contact-type thermometer as a remote sensor. However, in either case, when an infrared thermometer or the contact-type thermometer is used for detecting a temperature rise of the facility, the monitoring is limited to only a part of the facility, neither are suitable to monitor a wide area of a facility.

Furthermore, in a conventional video detection system, a signal generated by detecting a significant change in the object scene is used to actuate an alarm system, to trigger a memory device to later output stored information, or to initiate a video tape recorder and so on. However, in these systems there remains the problem that once the trigger signal is output, the scene prior to the trigger signal cannot be reproduced.

SUMMARY OF THE INVENTION

An object of the present invention is to provide a monitoring system to detect an abnormal temperature change in an object scene.

Another object of the present invention is to detect abnormal temperature changes caused by trouble in a facility or the presence of an unexpected person such as a burglar.

Yet another object of the present invention is to provide a monitoring system which responds only to an object larger than a predetermined size and within a predetermined temperature range.

A further object of the present invention is to provide a monitoring system to reproduce scenes existing prior to as well as after detection of an abnormal temperature change in an object scene.

According to the present invention, temperature data of each picture element output from an infrared camera is alternately stored in a pair of frame memories, each frame replacing previous data stored therein. Current input data is compared with the data of the previous frame stored in the opposite frame memory, to detect a change in temperature. The picture elements belonging to each of a number of predetermined temperature segments are grouped as a histogram. The total quantity of picture elements in a predetermined temperature range and over a predetermined first threshold quantity in each of the predetermined temperature segments is calculated for each frame. If the total is more than a second predetermined threshold quantity, a trigger signal is output to actuate an alarm system. The trigger signal may suspend a circulating memory device which stores data of the object scene taken prior to and/or after the trigger signal so that the abnormal scene can be compared with prior and/or subsequent scenes. The quantity/temperature threshold levels for outputting the trigger signal may be selected from a plurality of specification tables depending on the object scene to be monitored by respective infrared cameras.

The above-mentioned features and advantages of the present invention, together with other objects and advantages, which will be subsequently apparent, reside in the details of construction and operation as more fully described and claimed hereinafter, reference being had to the accompanying drawings forming a part hereof, wherein like reference numerals refer to like parts throughout.

BRIEF DESCRIPTION OF THE DRAWINGS

FIGS. 5(*a*) and 5(*b*) are explanatory diagrams illustrating the operation of the second embodiment of the present invention;

DESCRIPTION OF THE PREFERRED EMBODIMENTS

Figure 3A:
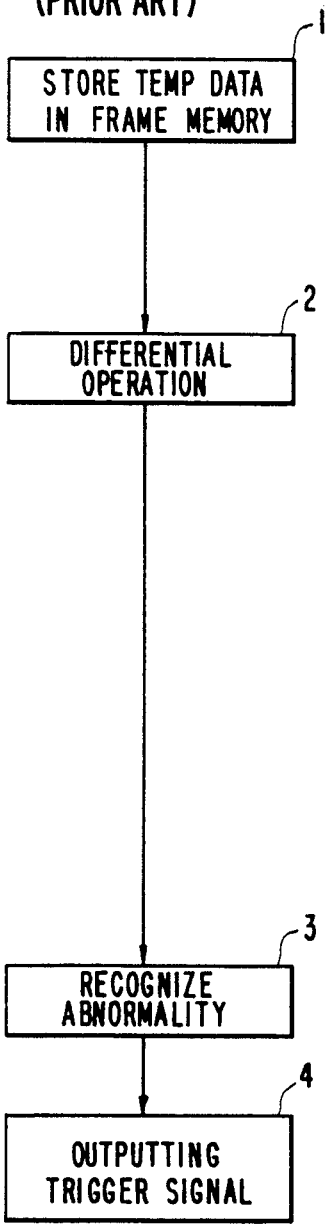
FIG. 3(a) (PRIOR ART)
FIGS. 3(*a*), 3(*b*), and 3(*c*) are flow charts for comparing a prior art system, to the first and second embodiments of the present invention.
Figure 3B:
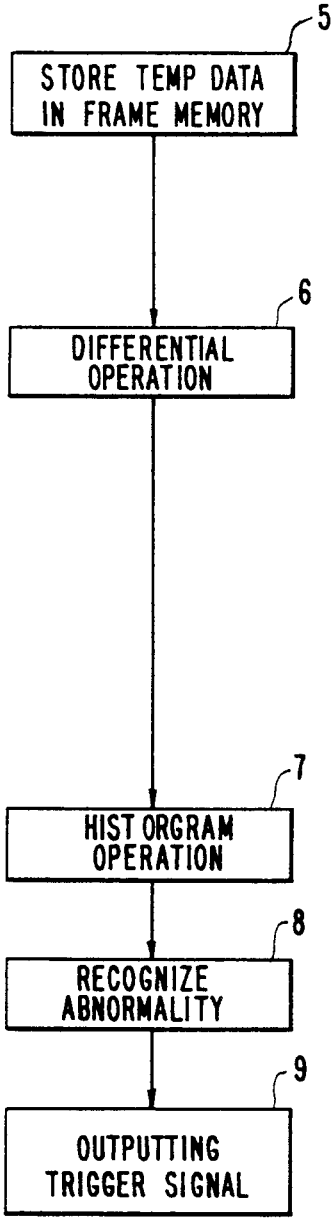
Figure 3C:
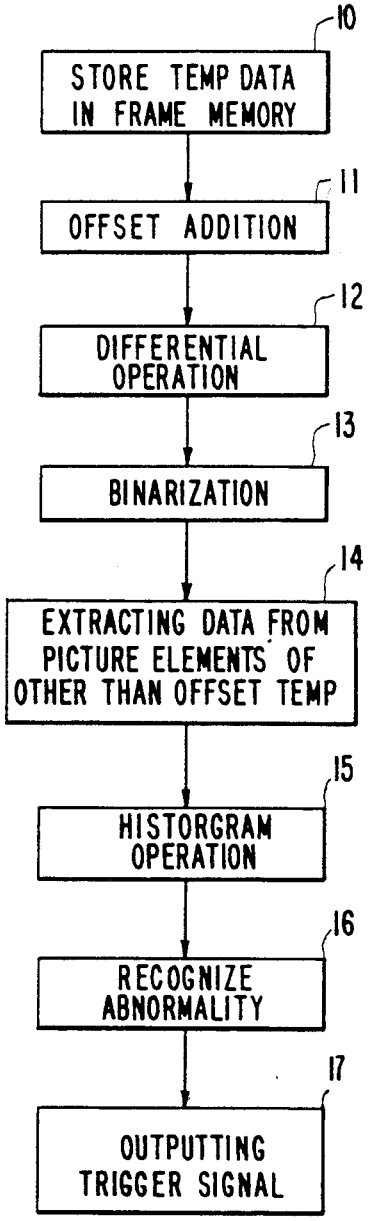

Referring to the block diagram in FIG. 1 and the flow chart in FIG. 3(*b*), a first embodiment of the present invention is hereinafter described. FIG. 3(*a*) shows a flow chart representing a prior art system for comparison. An infrared camera 1, having picture elements of, for example, approximately 8000 elements and approximately 1.5 frames per second, looks at an object scene to be watched. The infrared camera 1 sequentially outputs a brightness signal, i.e., temperature data for each picture element. A memory control circuit 2 receives the temperature data from the infrared camera 1 and delivers it to one of frame memories 3 and 4, alternately one frame at a time, as indicated in step (5) of FIG. 3(*b*). Each of the frame memories 3 and 4 has enough storage capacity to store one frame of temperature data, for example, 48K bits. The addresses of each picture cell are the same for each of the frame memories 3 and 4. When the current temperature data is stored in frame memory 3 or 4, data stored therein earlier is replaced by the newly stored data.

Differential operator 5 compares the current temperature data for each picture element in one 3 (or 4) of the frame memories with the previous frame's data stored in the same address of the other frame memory 4 (or 3), as indicated in step (6) of FIG. 3(*b*), and outputs the comparison difference to a monitor screen 6. Accordingly, the monitor screen 6 displays only the picture elements where the current temperature has changed from the previous frame, and the brightness of the displayed portion indicates the temperature difference.

Figure 4:
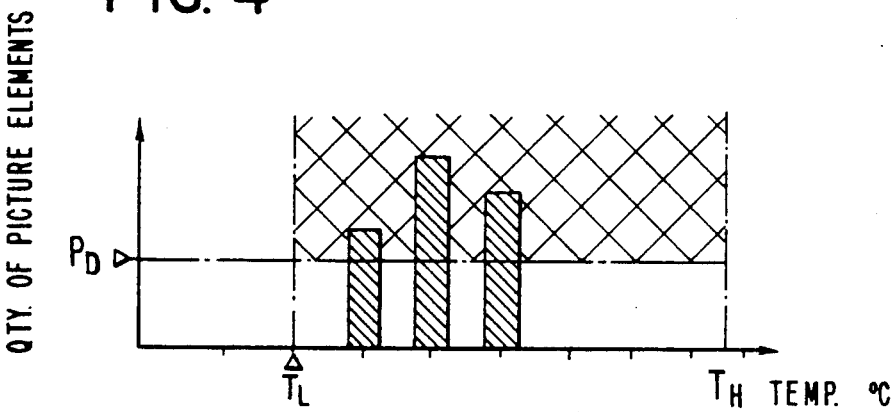
FIG. 4. is a histogram employed in a histogram operator of the present invention.

The temperature difference signal output from the differential operator 5 is also input to a histogram operator 10, as indicated in step (7) of FIG. 3(*b*). The histogram operator 10 is composed of digital data processing circuits in which the quantity of picture elements belonging to predetermined temperature segments, such as 30.0 to 30.9° C. 31.0 to 31.9° C. and so on, are respectively grouped and counted so as to make a histogram as shown in FIG. 4. After the counting in the histogram operator 10 is finished for each frame, if the total quantity of picture elements within the hatched area shown in FIG. 4 exceeds a predetermined second threshold quantity level $Q_D$ (not shown in the figure), then it is recognized that the temperature change in the object scene is of an abnormal state. Accordingly, the histogram operator 10 outputs a trigger signal as shown in step (9) of FIG. 3(*b*).

The above-mentioned hatched area is defined as an area where the temperature change is higher than a predetermined first threshold temperature $T_L$, for example, 31.0° C., and lower than a predetermined second threshold temperature $T_H$, for example, 39.0° C., as well as by the number of the picture elements grouped in each temperature segment greater than a predetermined first threshold quantity $P_D$. For example, with the first threshold temperature $T_L$, equal to 31.0° C., the histogram operator 10 can detect relatively sudden increases in temperature exceeding 31° C., thus indicating overheating in a facility. The second threshold temperature $T_H$ may sometimes be omitted depending on the system requirements. The histogram is formed according to the variable threshold conditions, including $T_L$, $T_H$, $P_D$ and $Q_D$, installed in firmware of the histogram operator 10 or selected from preprogrammed software containing specification tables. As a result of the histogram operation, neither a small object, such as a small animal, nor an object having only a slight temperature change is recognized as an abnormal state; therefore, the histogram operator 10 does not output a trigger signal in such cases.

The trigger signal is used for actuating an alarm system 9, a video tape recorder or other circuit as described later on. In the above-described steps of the operations, the steps (5), (6) and (9) are essentially the same as the steps (1), (2) and (4) of the prior art system illustrated in FIG. 3(*a*).

Use of a histogram operation to monitor temperature change effectively achieves the purpose of emergency monitoring. Temperature change provides a representative indication of an abnormality, i.e., an emergency. By using a histogram operation, a detection system according to the present invention is not disturbed by a slight change of an object in the visual scene with little or no temperature change. Thus, dependability of the watching system is greatly improved. Another advantage of using a histogram operation in monitoring temperature change is that the histogram conditions can be designed to meet different purposes, i.e., depending upon the type of object to be monitored.

A second embodiment of the present invention is hereinafter described with reference to the block diagram in FIG. 2 and the flow chart in FIG. 3(*c*). The infrared camera 1, the memory control circuit 2 and the frame memories 3 and 4 are essentially the same as those of FIG. 1. A detailed explanation is further made with reference to FIG. 5.

In FIG. 5(*a*), at a time $t_1$ no abnormal temperature change is generated yet and the temperature of the object scene is 10° C. In the next (current) frame of temperature data at a time $t_2$, an abnormal object having a temperature of 30° C. is detected. An offset temperature of 20° C. is added to the temperature of both the background scene and the object with the abnormal temperature change; accordingly they become 30° C. and 50° C., respectively. In other words, the offset temperature 20° C. is added in an offset adder 11 to the current temperature data, which is currently input to the frame memory 3 (or 4), for each picture element, as shown in step (11) of FIG. 3(*c*). The output of the offset adder is input to the differential operator circuit 5', and is compared therein with the output from the frame memory 4 (or 3) storing the temperature data of the previous frame, i.e., of time $t_1$, as in step (12) of FIG. 3(*c*) for each picture element. That is to say, the background temperature 10° C. of the previous frame is deducted from each of the offset-added current temperatures of the background scene, 30° C., and of the object with the abnormal temperature change, 50° C., respectively. Accordingly, the resultant temperatures become 20° C. and 40° C., respectively. The temperature difference data of each picture element output from the differential operator circuit 5' is, then, binarized in a binarization circuit 12 by the offset temperature 20° C., as described hereinafter.

The binarization circuit 12 outputs a "0" level for each picture element having the offset temperature 20° C., and outputs a level "1" for each picture element having a temperature other than the offset temperature 20° C. An output of "1" from the binarization circuit 12 enables an extractor circuit 13, which extracts the temperature data of a picture element from the frame memory 3 (or 4) into which data from the camera is currently input. The data extracted by the extractor circuit 13 is, then, input to the histogram operator 10, where, for example, the first threshold temperature $T_L$ has been set at 30° C. as shown in the histogram of FIG. 5(*a*). The histogram operation is essentially the same as that of the first preferred embodiment of FIG. 1. Accordingly, essentially the same procedure is carried out in the histogram operation in step (15) of FIG. 3(*c*) as in step (7) of FIG. 3(*b*). Moreover, steps (10), (16) and (17) of FIG. 3(*c*) are also essentially the same as steps (5), (8) and (9) of FIG. 3(*b*). The output of the histogram operator 10, i.e., the trigger signal, actuates an alarm system 9 in the same way as the first preferred embodiment shown in FIG. 1.

The advantage of employing an offset addition step is illustrated with reference to FIG. 5(*b*). In the case illustrated in FIG. 5(*b*), the temperature of the abnormal object is 30° C., which is lower than the background temperature 40° C. The output of the differential operator circuit 5' becomes −10° C. However, it is not desirable to have the following steps handle both positive and negative values. By using an offset addition, the results of the differential operation will always fall on positive values, even in the case where a burglar having a temperature of 30° C. invades into a scene of higher temperature such as 40° C. Accordingly, the offset temperature, e.g., 20° C., is chosen to be larger than the temperature difference 10° C. of the anticipated background temperature 40° C. which is higher than the anticipated abnormal object temperature 30° C. Thus, the circuit structure can be simplified.

Furthermore, the temperature data of only the picture elements having a temperature change are extracted to be input to the histogram operator 10. Thus, according to the introduction of the histogram operation a natural temperature change in the background does not require an adjustment of the first threshold temperature $T_L$ over which the quantity of the picture elements is to be counted. Such a natural temperature change would include, for example, the seasonal temperature change from winter to summer or from night to day. Although in the above description the offset temperature is chosen as 20° C., it is apparent that other temperatures besides 20° C. can be used depending on the particular system requirements.

Figure 6:
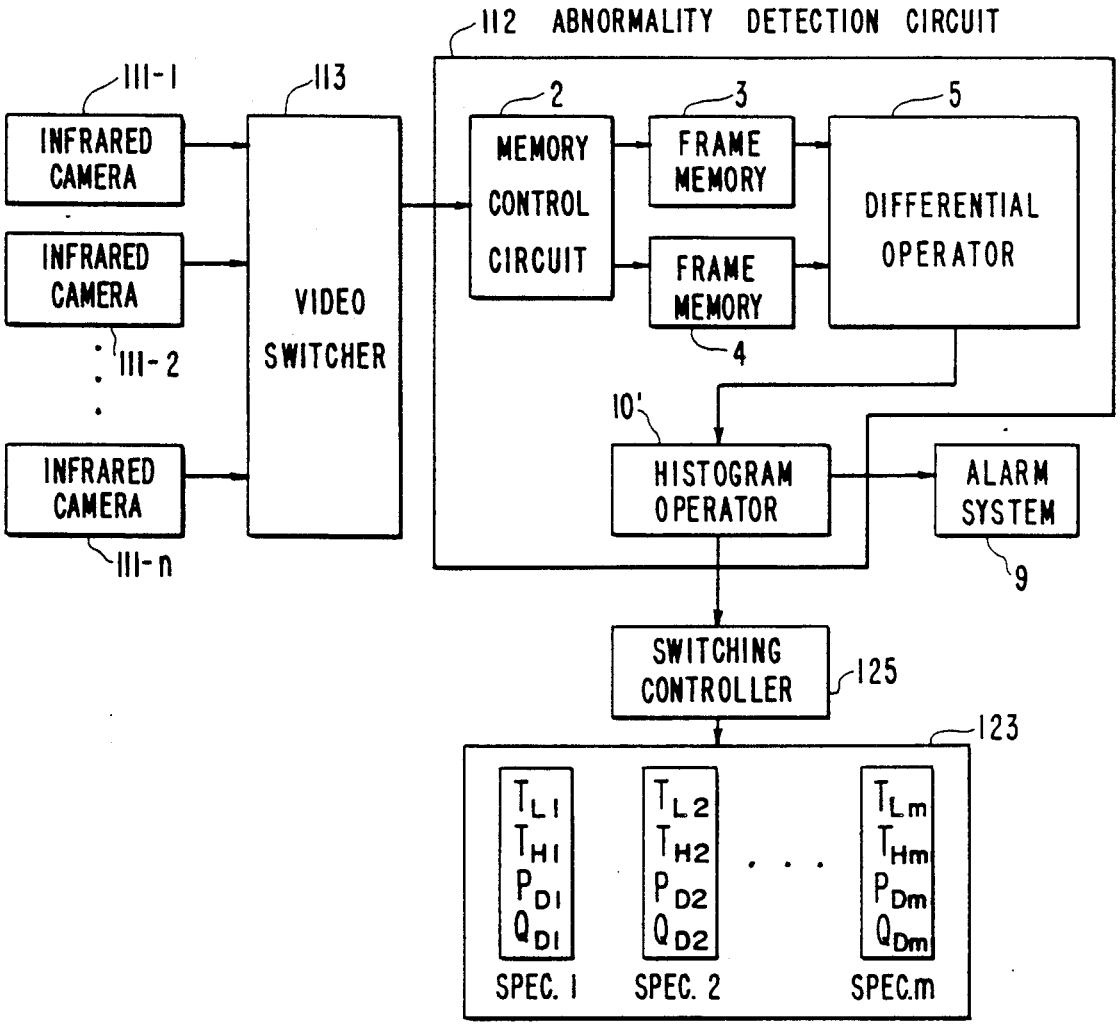
FIG. 6 is a block diagram of a third embodiment of the present invention.

A third embodiment of the present invention is hereinafter described with reference to FIG. 6. The third embodiment includes a plurality (n) of infrared cameras 111-1 through 111-n. Each infrared camera is essentially the same as that of the first infrared camera 1 of the first embodiment shown in FIG. 1; however, they respectively look at different object scenes. A video switcher 113 selects one of the infrared cameras 111 to deliver its output to an abnormality detection circuit 112.

The abnormality detection circuit 112 is composed of essentially the same elements as the memory control circuit 2, the frame memories 3 and 4, and the differential operator 5, of the first embodiment, except that the histogram operator 10' operates according to variable threshold conditions, i.e., specifications. These variable threshold conditions are provided by a plurality (m) of specification tables 123, each of which stores different specifications that define the hatched area of FIG. 4. These specifications or variable threshold conditions may include a first threshold quantity $P_D$, a first threshold temperature $T_L$, a second threshold temperature $T_H$, and a second threshold quantity $Q_D$, used in the histogram operation by the histogram operator 10'.

A switching controller 125 outputs a signal to actuate the video switcher 113 to sequentially select one of the infrared cameras 111 and, at the same time, to select the predetermined specification table 123 which corresponds to the selected camera. The specification data of the selected specification table is input to the histogram operator 10' via the switching controller 125. When the histogram operator 10' recognizes that the signal from the selected camera exceeds the threshold conditions input from the corresponding specification table, the histogram operator 10' outputs a trigger signal to an alarm system 9, which may be essentially the same as that described in the first and second embodiments illustrated FIGS. 1 and 2.

Figure 7:
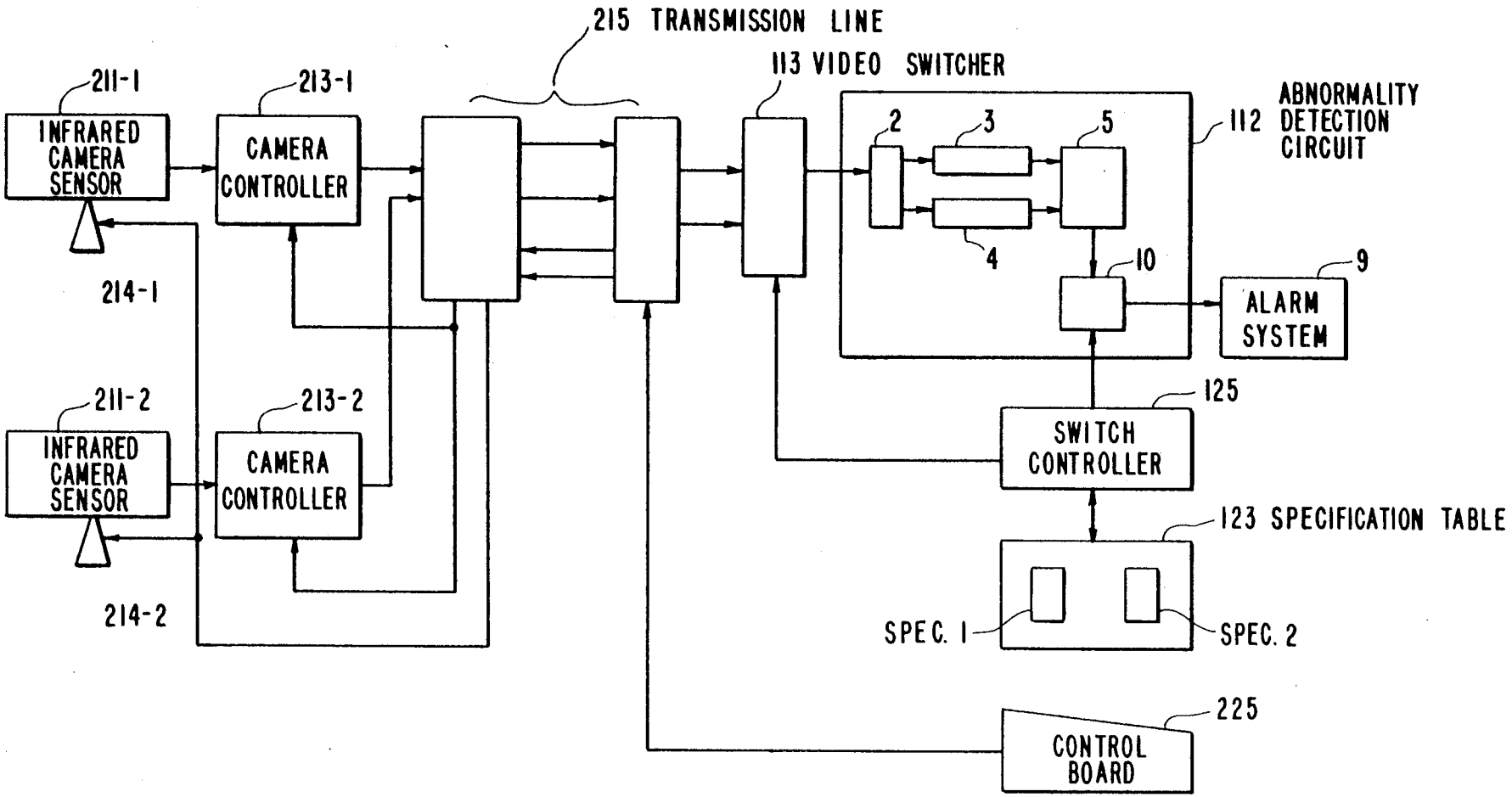
FIG. 7 is a detailed block diagram of the third embodiment of the present invention.

A more detailed block diagram of the third embodiment of the present invention is provided in FIG. 7, where the same or like reference numerals denote the same or corresponding devices. A first infrared camera sensor 211-1 is provided, for example, to monitor for a burglar. A camera controller 213-1 is instructed by a control board 225 via a transmission line 215 to give operating conditions, such as monitoring temperature range, temperature segmentation width, etc., to the first infrared camera sensor 211-1. The monitoring temperature range is set, therefore, typically from 0 to 40° C. for the camera monitor 211-1. The camera controller 213-1 also delivers an output signal of the camera sensor 211-1 to the transmission line 215. The camera sensor 211-1 is moved by a stage 214-1, instructed via the transmission line 215 by the control board 225. This allows the camera sensor 211-1 to properly look at the object scene, in this example, a path through which a burglar may invade the facilities to be protected. The infrared camera sensor 211-1, the camera controller 213-1 and the stage 214-1 comprise the infrared camera 111 of FIG. 6.

A second infrared camera sensor 211-2 is provided for monitoring an abnormal temperature rise in the facility, for example, at an electric power transformer. The camera sensor 211-2 is positioned to view this transformer, and the temperature range is set typically from 20 to 300° C. by the camera controller 213-2. The transmission line 215 is of a generally used bidirectional multi-channel transmission system, such as optical fiber, telephone line, etc. The video switcher 113 is composed of a plurality of general switches, such as mechanical switches or semiconductor switches. A switch in the video switcher 113 selectively connects an output of camera sensor 211 via the camera controller 213 and the transmission line 215 to the memory control circuit 2, according to a timing signal from switch controller 125.

This embodiment also has two specification tables 123-1 and 123-2 which correspond to camera sensors 211-1 and 211-2, respectively. The first table 123-1 stores the conditions for burglar detection specifying, for example, $P_D$: 2, $T_L$: 10° C., $T_H$: 35° C. and $Q_D$: 4 to 20, for the first infrared camera sensor 211-1 having approximately 8000 picture elements. The second specification table 123-2 stores the conditions for facility trouble detection specifying, for example, $P_D$: 2, $T_L$: 80° C., $T_H$ 100° C. and $Q_D$: 4 to 20. Accordingly, during the time period during which the first camera sensor 211-1 is selected, the first specification SPEC.1 is input to the histogram operator 10' and, likewise, the second specification SPEC.2 is supplied when the second camera 211-2 is selected. The period required to select one camera sensor and the corresponding specification table is, for example, 10 milliseconds, during which the histogram operation is fully carried out.

Although only two sets of the cameras and corresponding specification tables are provided in FIG. 7, any number of additional cameras and specification tables can be added. For example, in a case of additionally monitoring a power circuit breaker, suitable histogram operation conditions can be stored in an additional specification table. This allows quite different objects, such as detecting a burglar and facility trouble, each of which requires different individual threshold conditions, to be efficiently monitored at the same time using a single histogram operator.

Figure 1:
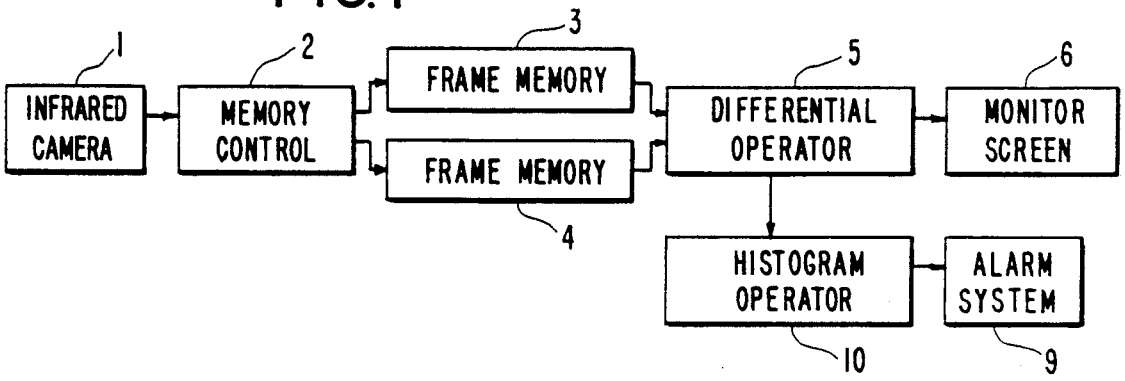
FIG. 1 is a block diagram of a first embodiment of the present invention.
Figure 2:
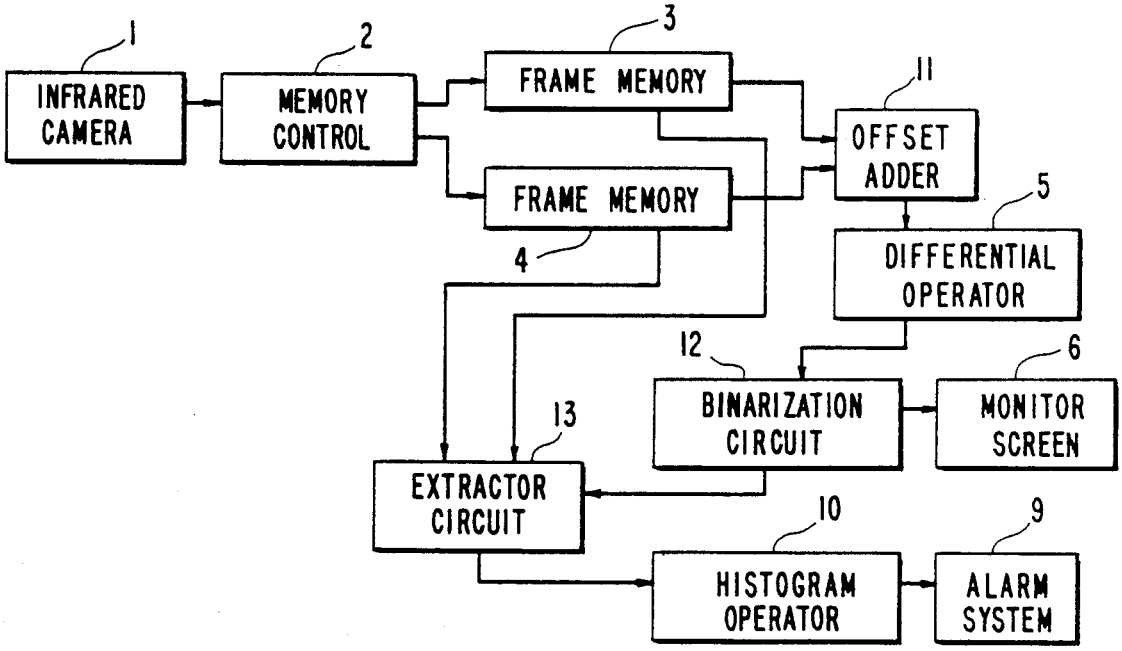
FIG. 2 is a block diagram of a second embodiment of the present invention.

In the third embodiment the histogram operator 10' was described as essentially the same as the histogram operator 10 of the first embodiment shown in FIG. 1. However, the data input to the histogram operator 10' in FIG. 7 also may be processed with offset addition as well as with the binarization operation described in the second embodiment shown in FIG. 2.

Figure 8:
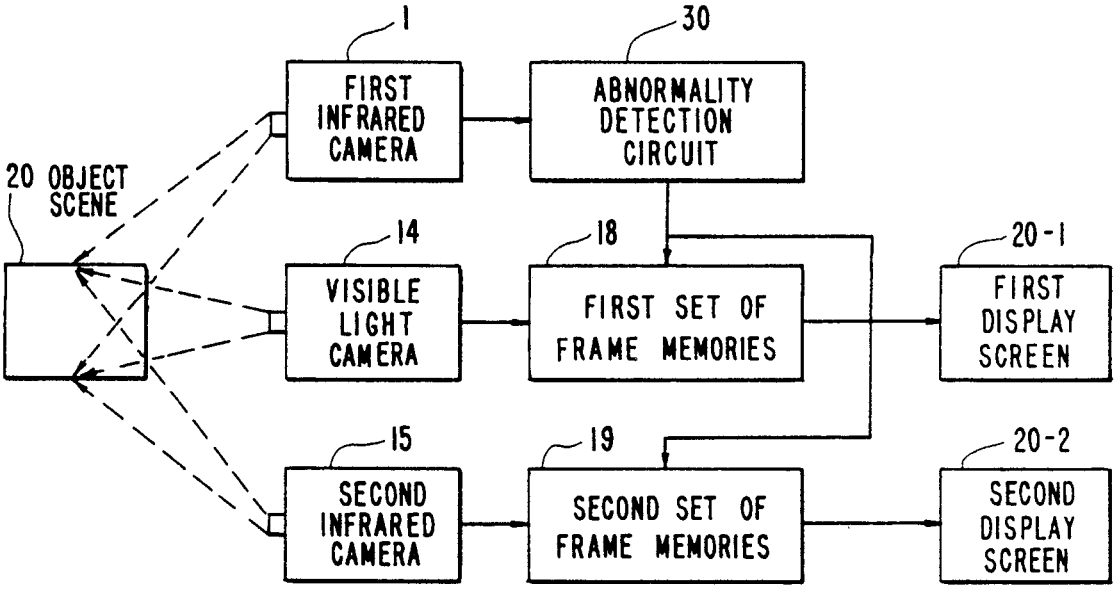
FIG. 8 is a block diagram of a fourth embodiment of the present invention.

A fourth embodiment of the present invention is illustrated in the block diagram of FIG. 8. A first infrared camera 1, a visible light camera 14 and a second infrared camera 15 look at and monitor the same object scene 20. The first infrared camera 1 is the same as that of FIG. 1, and is provided to detect an abnormal temperature change in the scene 20. The visible light camera 14 and the second infrared camera 15 are provided for reproducing the scenes of before and/or after an occurrence of an abnormal temperature change, as explained later in detail. The cameras 14 and 15 are generally synchronized in their frame scanning.

The output signal of the first infrared camera 1 carrying temperature data of each picture element is input to an abnormality detection circuit 30. The abnormality detection circuit 30 may comprise the memory control circuit 2, the frame memories 3 and 4, the differential operator 5 and the histogram operator 10 of FIG. 1. Alternative constructions of the abnormality detection circuit 30 are described later.

Figure 9:
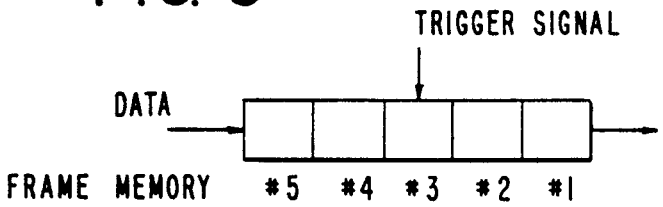
FIG. 9 is an explanatory diagram illustrating the operation of the circulating memory employed in the fourth embodiment of the present invention.

A first set of frame memories 18 is composed of a plurality of frame memories, each of which circulatingly stores image data, such as brightness and chromaticity, of each picture element of sequential frames, output from the visible light camera 14. Each of the frame memories 18 is typically composed of one or more widely used 64K semiconductor RAM (random access memory) devices. A second set of frame memories 19 is also composed of a plurality of frame memories. However, the second set of frame memories 19 circulatingly stores temperature data of each picture element of sequential frames, output from the second infrared camera 15. Likewise, each of the second set of frame memories 19 is typically composed of one or more widely used 64K semiconductor RAM devices. The number of the frame memories of the first and second sets 18 and 19 is, for example, five each as shown in FIG. 9. Moreover, the number of frame memories in the first and second sets 18 and 19 are typically equal.

The operation of the above-described sets of frame memories 18 and 19 in circulatingly storing the image data is illustrated in FIG. 9. Each of the five frame memories #1 through #5, as shown in FIG. 9, stores the image data of the five sequential frames, respectively, where the data stored in the #1 frame is replaced by the data of a sixth frame. The same procedure is repeated for successive frames, the seventh frame data in the #2 frame and so on. The circulating storage operation is stopped when the trigger signal is output from the abnormality detection circuit 30. Assuming that the trigger signal is output when the #3 frame memory is replaced with the current frame data as shown in FIG. 9, the scene occurring when a certain temperature change defined by the histogram conditions takes place can be reproduced by reading out the data stored in #3 frame memory. Furthermore, the scenes before that can be reproduced from the data in the #2, #1, #5 and #4 frame memories in the order of increasingly older frames.

Accordingly, assuming a case where the abnormality is a fire, the developing process of the fire can be traced back by the records of the past four frames. Thus, the temperature data stored in any frame of the second set of frame memories 19 can be reproduced as a visual image on a second display screen 20-2. In the same manner, the visible light camera's data stored in the first set of the frame memories 18 can be reproduced as a visual image showing the development of the smoke on a first display screen 20-1.

Although in this description of the embodiment of the present invention the circulating storage of the frames is stopped at the end of the frame by which the trigger signal is generated, the circulating storage may be arranged so as to stop after data of some additional frames, i.e., subsequent data are stored in the circulating memories 18 and 19. Then, the development of the abnormal state can be observed from the frames of subsequent data even after the trigger signal.

It is very advantageous for a watchman to be able to know the history of the successive development of the flame and the smoke, etc., by visual images both prior to and/or after the detection of the abnormal state, including information on the temperature, colors and shapes, so that the watchman can judge the status correctlY and determine a measure to protect a further development of the emergency state. Moreover, the visible light camera system 14, 18 and 20-1 is particularly advantageous in daytime monitoring, and the second infrared camera system 15, 19 and 20-2 is particularly advantageous in night-time monitoring.

Although in this description of the preferred embodiment, frame memories 3 and 4 are provided in the abnormality detection circuit 30, two of the frame memories in the second set of frame memories 19 may also be used as frame memories 3 and 4, with some modification of the circuits according to widely known circuit technique. This reduces the number of the expensive frame memories required. In addition, the functions of the first and second infrared cameras may be combined and performed by a single infrared camera.

Figure 10:
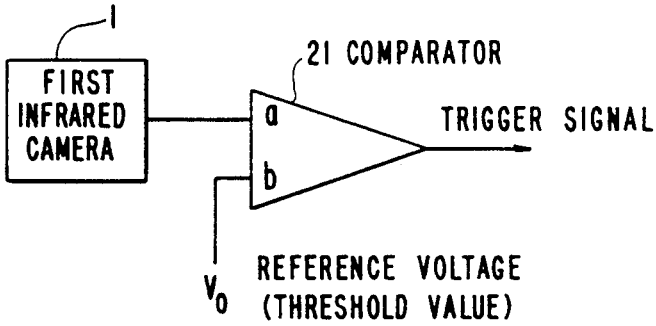
FIG. 10 is a block diagram of a comparator employed as an abnormality detection circuit in the fourth embodiment of the present invention.

As an alterative, the abnormality detection circuit 30 may also include the offset adder 11, the binarization circuit 12 and the extractor circuit 13 as described in the second embodiment. On the other hand, the abnormality detection circuit 30 may also be composed simply of a comparator 21, as shown in FIG. 10, without the frame memories 3 and 4, or the histogram operator 10.

In this case, where the size of the temperature-changed object is not in consideration, the comparator 21 outputs a trigger signal when a temperature signal from the first infrared camera 1 is higher than a threshold voltage $V_O$ corresponding to a predetermined temperature level.

Although the number of frames in the first and second set of frame memories 18 and 19 was referred to as five each, the number may be increased depending on particular system requirements. For the first and second set of the frame memories 18 and 19, not only a RAM but also a disk memory may be employed.

The many features and advantages of the present invention are apparent from the detailed specification and thus, it is intended by the appended claims to cover all such features and advantages of the system which fall within the true spirit and scope of the invention. Further, since numerous modifications and changes will readily occur to those skilled in the art from the disclosure of the invention, it is not desired to limit the invention to the exact construction and operation shown and described, and accordingly, all suitable modifications and equivalents may be resorted to, falling within the scope and spirit of the invention.

What is claimed is:

1. A temperature monitoring system, comprising:

at least one infrared camera for outputting temperature data of an object scene, the temperature data corresponding to a frame of picture elements;

a pair of frame memories arranged in parallel, each storing the temperature data, the temperature data including one of current temperature data in a current frame and previous temperature data in a previous frame;

memory control means, operatively connected to said infrared camera and said frame memories, for receiving the temperature data from said infrared camera and delivering the temperature data of each frame alternately to one of said frame memories;

a differential operator, operatively connected to said frame memories, for comparing the temperature data of each picture element of the current frame with the temperature data of corresponding picture elements of the previous frame and outputting differences therebetween as temperature difference signals; and histogram operator means, operatively connected to said differential operator, for counting the picture elements having temperature difference signals within each of a plurality of predetermined temperature segments to produce a plurality of segment counts and for issuing a trigger signal in dependence upon at least one of the segment counts and at least one predetermined threshold condition.

2. A temperature monitoring system as recited in claim 1, wherein the plurality of predetermined threshold conditions comprise a first threshold temperature for determining a first extreme value of the predetermined temperature segments and a first threshold quantity.

3. A temperature monitoring system as recited in claim 2, wherein the plurality of predetermined threshold conditions further comprises a second threshold temperature for determining a second extreme value of the predetermined temperature.

4. A temperature monitoring system as recited in claim 3, wherein said histogram operator means issues the trigger signal in further dependence upon at least one of the segment counts exceeding the first threshold quantity.

5. A temperature monitoring system as recited in claim 4, wherein the plurality of predetermined threshold conditions further comprises a second threshold quantity, and wherein said histogram operator means issues the trigger signal in further dependence upon a total quantity exceeding the second threshold quantity, the total quantity being determined by summing amounts by which each of the segment counts exceeds the first threshold quantity.

6. A temperature monitoring system comprising:

at least one infrared camera for outputting temperature data of an object scene, the temperature data corresponding to a frame of picture elements;

a pair of frame memories, each storing the temperature data of the frame, the temperature data including one of current temperature data in a current frame and previous temperature data in a previous frame;

memory control means, operatively connected to said infrared camera and said frame memories, for receiving the temperature data from said infrared camera and delivering the temperature data of each frame alternately to one of said frame memories;

offset adder means, operatively connected to said frame memories for adding an offset temperature to the temperature data for each of the plurality of picture elements of the current frame to produce offset temperature data;

a differential operator, operatively connected to said offset adder means, for comparing the offset temperature data of each picture element of the current frame with the temperature data of corresponding picture elements of the previous frame and outputting differences therebetween as temperature difference signals; and histogram operator means, inoperatively connected to said differential operator, for counting the picture elements having temperature difference signals within at least one predetermined temperature segment to produce at least one segment count and for issuing a trigger signal in dependence upon the at least one segment count and at least one predetermined threshold condition.

7. A temperature monitoring system as recited in claim 6, further comprising extractor means, operatively connected to said frame memories and between said differential operator and said histogram operator means, for extracting the temperature data, if the temperature difference signal is other than the offset temperature, from said plurality of frame memories and delivering the temperature data to said histogram operator means.

8. A temperature monitoring system as recited in claim 7, wherein said at least one infrared camera includes a plurality of infrared cameras, and wherein said temperature monitoring system further comprises a video switcher, operatively connected to said plurality of infrared cameras and said memory control means, for selecting one of said plurality of infrared cameras.

9. A temperature monitoring system as recited in claim 8, further comprising:

table storage means for storing a plurality of specification tables each containing the at least one predetermined threshold condition for at least one corresponding infrared camera of said plurality of infrared cameras; and switching controller means, operatively connected between said histogram operator means and said table storage means, for selecting one of the plurality of specification tables.

10. A temperature monitoring system as recited in claim 3, wherein the at least one predetermined threshold condition includes a plurality of predetermined threshold conditions, the at least one predetermined temperature segment includes a plurality of predetermined temperature segments and the at least one segment count includes a plurality of segment counts, and wherein the plurality of predetermined threshold conditions comprise a first threshold temperature for determining a first extreme value of the predetermined temperature segments and a first threshold quantity.

11. A temperature monitoring system as recited in claim 10, wherein the plurality of predetermined threshold conditions further comprises a second threshold temperature for determining a second extreme value of the predetermined temperature segments.

12. A temperature monitoring system as recited in claim 11, wherein said histogram operator means issues the trigger signal in further dependence upon at least one of the segment counts exceeding the first threshold quantity.

13. A temperature monitoring system as recited in claim 12, wherein the plurality of predetermined threshold conditions further comprises a second threshold quantity, and wherein said histogram operator means issues the trigger signal in further dependence upon a total quantity exceeding the second threshold quantity, the total quantity being determined by summing amounts by which each of the segment counts exceeds the first threshold quantity.

14. A monitoring system, comprising:

first and second infrared cameras for outputting temperature data of an object scene, the temperature data corresponding to a frame of picture elements;

a first set of frame memories, operatively connected to said first infrared camera, each storing temperature data corresponding to a sequential frame of picture elements output from said first infrared camera;

a visible light camera for outputting image data of the object scene, the image data corresponding to the frame of picture elements; and a second set of frame memories, operatively connected to said visible light camera, each storing image data corresponding to a sequential frame of picture elements output from said visible light camera.

15. A monitoring system comprising:

a first infrared camera for outputting temperature data of an object scene, the temperature data corresponding to a frame of picture elements;

a first set of frame memories, operatively connected to said first infrared camera, each storing temperature data corresponding to a sequential frame of picture elements output from said first infrared camera;

a visible light camera for outputting image data of the object scene, the image data corresponding to the frame of picture elements;

a second set of frame memories, operatively connected to said visible light camera, each storing image data corresponding to a sequential frame of picture elements output from said visible light camera; and abnormality detection means, operatively connected to said first set of frame memories, for issuing a trigger signal upon detecting an abnormal temperature change in the object scene in dependence upon the temperature data.

16. A monitoring system as recited in claim 15, wherein said first and second sets of frame memories store the temperature and image data, respectively, of each picture element of each sequential frame in a circulating storage.

17. A monitoring system as recited in claim 16, wherein upon issuance of the trigger signal the circulating storage in said first and second sets of frame memories is stopped, when said first and second sets of frame memories each contain at least one frame of data generated prior to issuance of the trigger signal.

18. A monitoring system as recited in claim 16, wherein subsequent to issuance of the trigger signal the circulating storage in said first and second sets of frame memories is stopped when said first and second sets of frame memories each contain at least one frame of data generated prior to and at least one frame of data generated subsequent to issuance of the trigger signal.

19. A monitoring system as recited in claim 16, wherein said abnormality detection means comprises a comparator for comparing the temperature data to a predetermined threshold reference value.

20. A monitoring system as recited in claim 16, wherein said first set of frame memories stores the temperature data including current temperature data and previous temperature data, and wherein said abnormality detection means comprises:

a differential operator for comparing the picture elements of the current temperature data with the picture elements of the previous temperature data and for outputting differences therebetween as a temperature difference signal; and histogram operator means, operatively connected to said differential operator, for counting the picture elements having temperature difference signals within at least one predetermined temperature segment to produce at least one segment count and for issuing a trigger signal in dependence upon the at least one segment count and at least one predetermined threshold condition.

21. A monitoring system as recited in claim 20, wherein said abnormality detection means further comprises offset adder means for adding an offset temperature to the current temperature data.

22. A temperature monitoring system as recited in claim 20, wherein the at least one predetermined threshold condition includes a plurality of predetermined threshold conditions, the at least one predetermined temperature segment includes a plurality of predetermined temperature segments and the at least one segment count includes a plurality of segment counts, and wherein the plurality of predetermined threshold conditions comprise a first threshold temperature for determining a first extreme value of the predetermined comparison to each of the segment quantities.

23. A temperature monitoring system as recited in claim 22, wherein the plurality of predetermined threshold conditions further comprises a second threshold temperature for determining a second extreme value of the predetermined temperature segments.

24. A temperature monitoring system as recited in claim 23, wherein said histogram operator means issues the trigger signal in further dependence upon at least one of the segment counts exceeding the first threshold quantity.

25. A temperature monitoring system as recited in claim 24, wherein the plurality of predetermined threshold conditions further comprises a second threshold quantity, and wherein said histogram operator means issues the trigger signal in further dependence upon a total quantity exceeding the second threshold quantity, the total quantity being determined by summing amounts by which each of the plurality of segment counts exceeds the first threshold quantity.

* * * * *

UNITED STATES PATENT AND TRADEMARK OFFICE

CERTIFICATE OF CORRECTION

PATENT NO. : 4,999,614

DATED : March 12, 1991

INVENTOR(S) : Ryuichi UEDA et al.

It is certified that error appears in the above-identified patent and that said Letters Patent is hereby corrected as shown below:

Title Page [57] ABSTRACT line 2, change "a infrared" to

--an infrared--;

line 4, change "date" to --data--;

Col. 8, line 45, change "correctlY" to

--correctly--.

Signed and Sealed this

Seventeenth Day of November, 1992

*Attest:*

DOUGLAS B. COMER

*Attesting Officer*

*Acting Commissioner of Patents and Trademarks*